US007424263B2

(12) United States Patent
Shimizu et al.

(10) Patent No.: US 7,424,263 B2
(45) Date of Patent: Sep. 9, 2008

(54) TONER RECOVERY BELT CONVEYOR, PROCESS CARTRIDGE, AND IMAGE FORMING APPARATUS USING THE SAME

(75) Inventors: Yoshiyuki Shimizu, Ohsaka (JP); Yoshihiro Kawakami, Hyogo (JP); Tomohiro Kubota, Ohsaka (JP); Hirobumi Ooyoshi, Tokyo (JP); Tomofumi Yoshida, Tokyo (JP); Koji Kato, Tokyo (JP); Kenzo Tatsumi, Ohsaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/608,973

(22) Filed: Dec. 11, 2006

(65) Prior Publication Data

US 2007/0140763 A1 Jun. 21, 2007

(30) Foreign Application Priority Data

Dec. 20, 2005 (JP) ..... 2005-367254

(51) Int. Cl.
*G03G 21/00* (2006.01)

(52) U.S. Cl. ..... 399/358; 399/359; 399/360; 399/120; 399/98; 399/99

(58) Field of Classification Search ..... 399/35, 399/106, 129, 264, 265, 358, 359, 360
See application file for complete search history.

(56) References Cited

U.S. PATENT DOCUMENTS 5,848,342 A * 12/1998 Tanda ..... 399/358
5,956,556 A * 9/1999 Nakajima et al. ..... 399/359
RE38,978 E * 2/2006 Nakajima et al. ..... 399/359
2004/0253022 A1* 12/2004 Arai et al. ..... 399/253

FOREIGN PATENT DOCUMENTS

JP 8-123275 5/1996

(Continued)

OTHER PUBLICATIONS

U.S. Appl. No. 11/870,136, filed Oct. 10, 2007, Tatsumi, et al.

(Continued)

*Primary Examiner*—David M. Gray
*Assistant Examiner*—G. M. Hyder
(74) *Attorney, Agent, or Firm*—Oblon, Spivak, McClelland, Maier & Neustadt, P.C.

(57) ABSTRACT

A toner recovery device, capable of preventing toner from spilling out of the space between protruding sections and an inner wall of a toner-conveying pipe, and process cartridge and image forming apparatus having this device. Residual toner after transfer, which is carried into a carry-in section of the toner-conveying pipe, is held by the protruding sections of a toner-conveying belt and a bottom surface of the toner-conveying pipe, and conveyed to a carry-out section. Accordingly, the residual toner after transfer can be prevented from oscillating while being conveyed to the carry-out section. Therefore, the residual toner after transfer is prevented from spilling out of the space between the protruding sections and the inner wall of the toner-conveying pipe, and the amount of residual toner after transfer to be conveyed to the carry-out section can be prevented from being reduced.

13 Claims, 7 Drawing Sheets

FOREIGN PATENT DOCUMENTS

| | | | |
|---|---|---|---|
| JP | 08123275 A | * | 5/1996 |
| JP | 9-185248 | | 7/1997 |
| JP | 11-73078 | | 3/1999 |
| JP | 11-258896 | | 9/1999 |
| JP | 3281595 | | 2/2002 |

OTHER PUBLICATIONS

U.S. Appl. No. 11/951,584, filed Dec. 6, 2007, Yoshida, et al.
U.S. Appl. No. 11/949,339, filed Dec. 3, 2007, Tatsumi, et al.
U.S. Appl. No. 11/967,635, filed Dec. 31, 2007, Shimizu, et al.
U.S. Appl. No. 12/020,915, filed Jan. 28, 2008, Kubota, et al.

* cited by examiner

TONER RECOVERY BELT CONVEYOR, PROCESS CARTRIDGE, AND IMAGE FORMING APPARATUS USING THE SAME

BACKGROUND OF THE INVENTION

1. Field of the Invention

The present invention relates to a toner recovery device, which conveys residual toner after transfer removed by cleaning means to a toner recovery section, a process cartridge comprising this toner recovery device, and an image forming apparatus comprising the toner recovery device or the process cartridge.

2. Description of the Background Art

There is known a toner recovery device, which uses cleaning means to remove residual toner after transfer remaining on a surface of an image supporting body after transferring a toner image on the image supporting body to a recording medium, and conveys the removed residual toner after transfer from the cleaning means to a toner recovery section for storing the residual toner after transfer. For example, Japanese Patent Application Publication No. 3281595 describes the following toner recovery device. Specifically, an endless groove is provided on a side frame of a process cartridge, a side plate is then fixed to the surface of the side frame on which the groove is formed, and the groove is covered with the side plate, whereby a toner-conveying pipe is formed. A carry-in section to which residual toner after transfer is carried from cleaning means is installed below the toner-conveying pipe, and this carry-in section is provided with a continuous hole communicating with the cleaning means. Also, a carry-out section, which is provided with a continuous hole communicating with the toner recovery section, is disposed above the toner-conveying pipe. Moreover, an endless toner-conveying belt provided with a plurality of protruding sections on an outer peripheral surface thereof is stored so as to be able to move along the groove. The residual toner after transfer, which is carried from the cleaning means into the carry-in section, is drawn up by means of protrusions of a transfer conveying belt as the toner-conveying belt moves, and the residual toner after transfer is then conveyed to the carry-out section located above the carry-in section. The residual toner after transfer, which is conveyed to the carry-out section by the toner-conveying belt, falls from the carry-out section to the toner recovery section, and is thereby collected into the toner recovery section.

However, in this conventional technology, when the toner-conveying belt is oscillated by oscillation of a drive section of the toner-conveying belt, the oscillation is transmitted to the residual toner after transfer supported on the toner-conveying belt. As a result, the residual toner after transfer supported on the toner-conveying belt oscillates, and thereby spills out of a space between the protruding sections and an inner wall of the toner-conveying pipe because of the weight of the residual toner after transfer. Therefore, there was a problem that the amount of toner supported on the toner-conveying belt is reduced in the middle of conveyance and that the amount of toner to be conveyed to the toner carry-out section is reduced.

Technologies relating to the present invention are also disclosed in, e.g., Japanese Patent Application Laid-Open No. H11-073078 and Japanese Patent Application Laid-Open No. H11-258896.

SUMMARY OF THE INVENTION

The present invention is contrived in view of the above problems, and an object thereof is to provide a toner recovery device, which can prevent toner from spilling out of the space between the protruding sections and the inner wall of the toner-conveying pipe, a process cartridge comprising this toner recovery device, and an image forming apparatus comprising the toner recovery device or the process cartridge.

In an aspect of the present invention, a toner recovery device conveys residual toner after transfer removed by a cleaning device to a toner recovery section. The toner recovery device comprises a toner-conveying pipe extending obliquely upward and having a carry-in section which is provided in a lower section of the toner-conveying pipe and into which the residual toner after transfer removed by the cleaning device is carried, and a carry-out section which is provided in an upper section of the toner-conveying pipe and conveys the residual toner after transfer to the toner recovery section; and an endless toner-conveying belt which has a plurality of protruding sections on an outer peripheral surface thereof, and is tightly stretched so as to be rotatable in the toner-conveying pipe. The toner-conveying belt is rotated such that the toner-conveying belt descends in a region in which the outer peripheral surface of the toner-conveying belt faces a ceiling surface of the toner-conveying pipe, and that the toner-conveying belt rises in a region in which the outer peripheral surface of the toner-conveying belt faces a bottom surface of the toner-conveying pipe. The residual toner after transfer carried into the carry-in section is held by the protruding sections of the conveying belt and the bottom surface of the toner-conveying pipe, and conveyed to the carry-out section.

In another aspect of the present invention, a process cartridge is detachable with respect to an image forming apparatus main body. The process cartridge comprises an image supporting body; a leaning device for removing residual toner after transfer adhered to the image supporting body; and a toner recovery device which conveys the residual toner after transfer removed by the cleaning means to a toner recovery section. The toner recovery device comprises a toner-conveying pipe extending obliquely upward and having a carry-in section which is provided in a lower section of the toner-conveying pipe and into which the residual toner after transfer removed by the cleaning means is carried, and a carry-out section which is provided in an upper section of the toner-conveying pipe and conveys the residual toner after transfer to the toner recovery section; and an endless toner-conveying belt which has a plurality of protruding sections on an outer peripheral surface thereof, and is tightly stretched so as to be rotatable in the toner-conveying pipe. The toner-conveying belt is rotated such that the toner-conveying belt descends in a region in which the outer peripheral surface of the toner-conveying belt faces a ceiling surface of the toner-conveying pipe, and that the toner-conveying belt rises in a region in which the outer peripheral surface of the toner-conveying belt faces a bottom surface of the toner-conveying pipe, and the residual toner after transfer carried into the carry-in section is held by the protruding sections of the conveying belt and the bottom surface of the toner-conveying pipe, and conveyed to the carry-out section.

In another aspect of the present invention, an image forming apparatus comprises a toner recovery device which conveys residual toner after transfer removed by cleaning means to a toner recovery section. The toner recovery device comprises a toner-conveying pipe extending obliquely upward and having a carry-in section which is provided in a lower section of the toner-conveying pipe and into which the residual toner after transfer removed by the cleaning means is carried, and a carry-out section which is provided in an upper section of the toner-conveying pipe and conveys the residual toner after transfer to the toner recovery section; and an endless toner-conveying belt which has a plurality of protruding sections on an outer peripheral surface thereof, and is tightly stretched so as to be rotatable in the toner-conveying pipe. The toner-conveying belt is rotated such that the toner-conveying belt descends in a region in which the outer peripheral surface of the toner-conveying belt faces a ceiling surface of the toner-conveying pipe, and that the toner-conveying belt rises in a region in which the outer peripheral surface of the toner-conveying belt faces a bottom surface of the toner-conveying pipe, and the residual toner after transfer carried into the carry-in section is held by the protruding sections of the conveying belt and the bottom surface of the toner-conveying pipe, and conveyed to the carry-out section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Before explaining the present invention, the toner recovery device disclosed in the abovementioned Japanese Patent Application Publication No. 3281595 is described with reference to the drawings.

Figure 1:
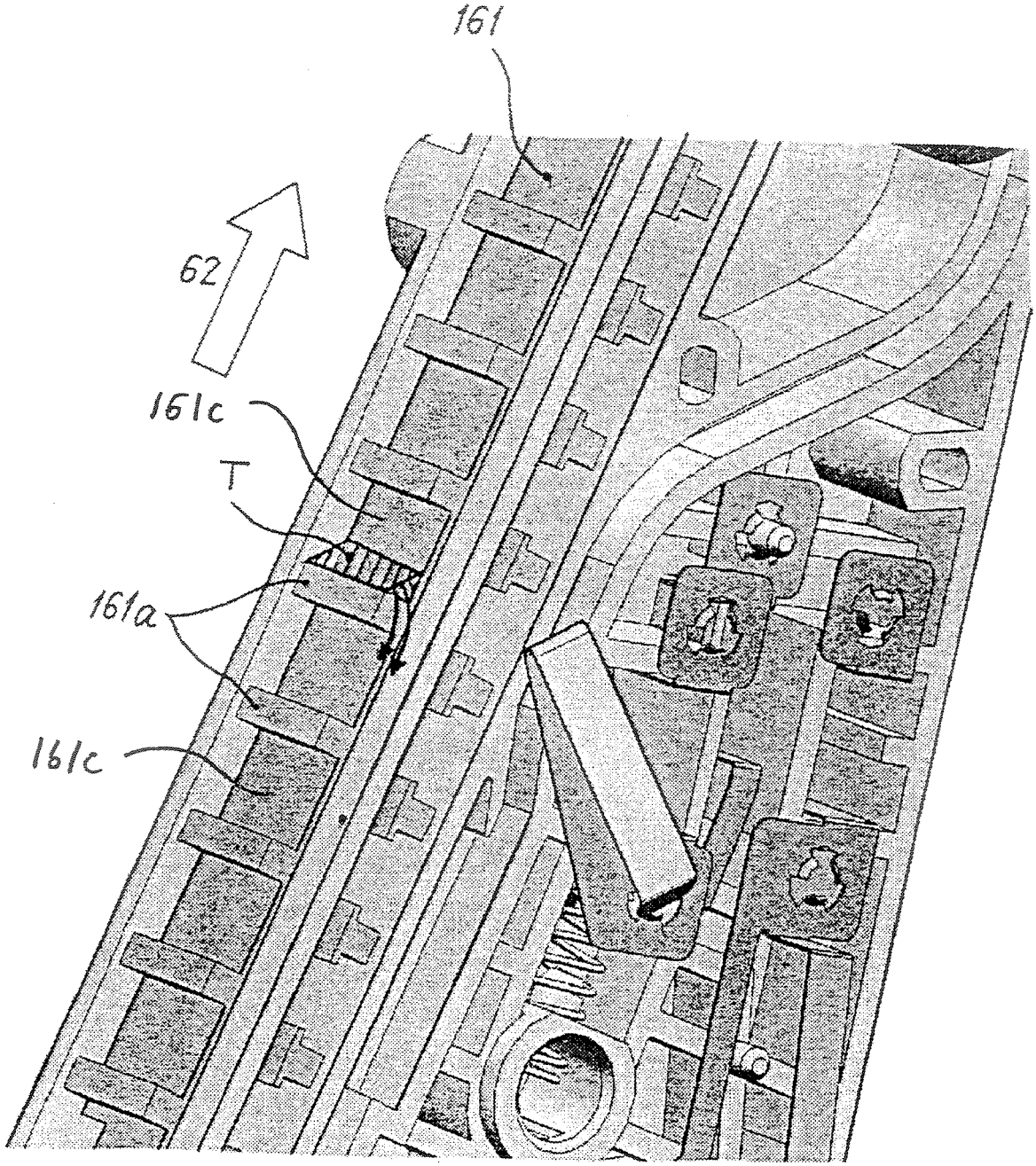
FIG. 1 PRIOR ART
FIG. 1 is a figure for explaining a state of conveying residual toner after transfer of a conventional toner recovery device.

In this publication, a residual toner after transfer T is conveyed such that the residual toner after transfer T is held by an outer peripheral surface 161*c* between protruding sections of a toner-conveying belt 161 and by the protruding sections 161*a*, as shown in FIG. 1. Specifically, the residual toner after transfer is supported on the toner-conveying belt and discharged to a carry-out section. However, if the toner-conveying belt 161 is oscillated by oscillation of a drive section of the toner-conveying belt 161 as described above, the oscillation is transmitted to the residual toner after transfer supported on the toner-conveying belt. As a result, the residual toner after transfer on the toner-conveying belt oscillates, and thereby spills out of a space between the protruding sections 161*a* and an inner wall of a toner-conveying pipe because of the weight of the residual toner after transfer. Therefore, there was a problem that the amount of toner supported on the toner-conveying belt 161 is reduced in the middle of conveyance and that the amount of toner to be conveyed to a toner carry-out section is reduced.

Hereinafter, an embodiment of an electrophotographic printer (simply referred to as "printer" hereinafter) is described as an image forming apparatus to which the present invention is applied.

First of all, a basic configuration of the printer is described.

Figure 2:
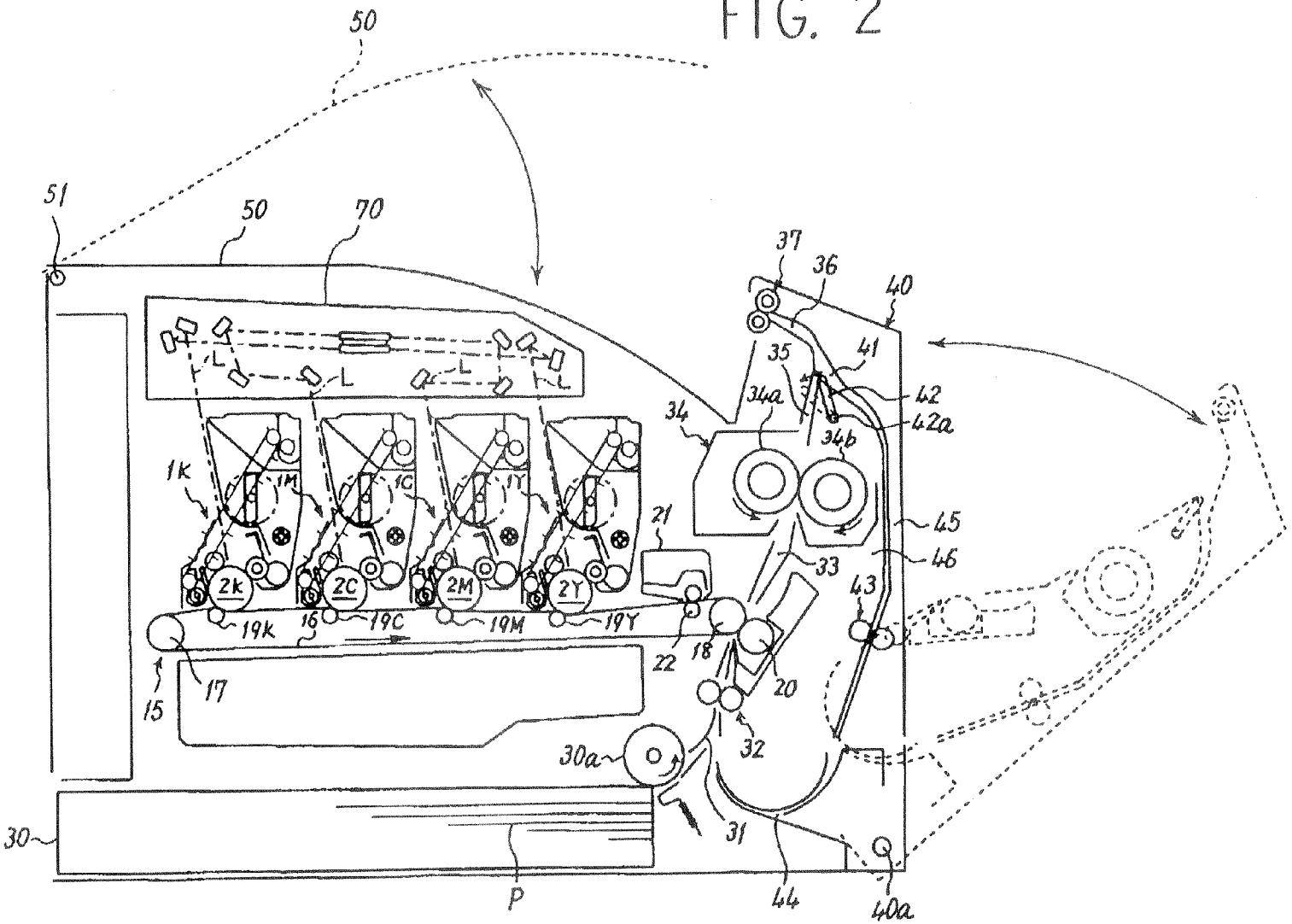
FIG. 2 is a figure showing a schematic configuration of a printer according to an embodiment of the present invention.

FIG. 2 shows a schematic configuration of the printer. In this figure, the printer has four process cartridges, 1Y, M, C, K, for forming toner images in yellow, magenta, cyan and black (designated as "Y, M, C, K" hereinafter). These cartridges have the same configuration other than that these cartridges use, as the image forming substances, Y, M, C, K toners that are different from one another in color, and these cartridges are replaced with new ones at the end of the lives thereof. In the following descriptions, explanations of the reference numerals, Y, C, M, K indicating different colors, are omitted because the configurations of the process cartridges, 1Y, C, M, K, are all the same.

Figure 3:
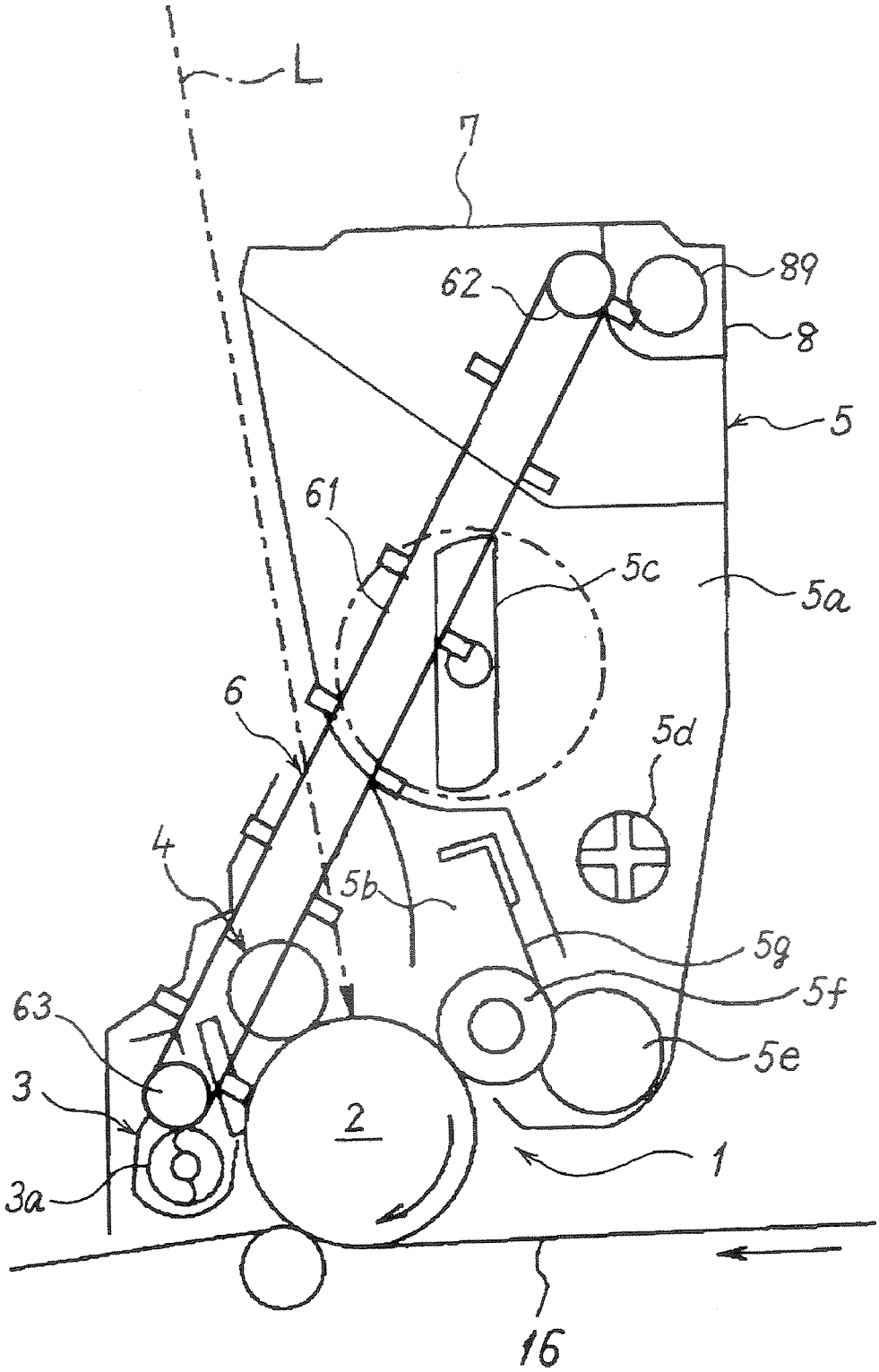
FIG. 3 is a figure showing a configuration of a process unit of the printer.

As shown in FIG. 3, a drum-like photoconductor 2 which is an image supporting body, a drum cleaning device 3 which is cleaning means, an electric charge removing device (not shown), a charging device 4, a development device 5, a toner recovery device 6 and the like are provided. The process cartridges 1, which are image forming units, are detachable with respect to the printer main body and can be replaced at once when worn out.

The charging device 4 uniformly charges a surface of the photoconductor 2 which is rotated in clockwise direction in the figure by unshown driving means. The uniformly charged surface of the photoconductor 2 is subjected to exposure scanning by a laser beam L to support an electrostatic latent image. This electrostatic latent image is developed into a toner image by the development device 5 using unshown toner. Then, the toner image is intermediately transferred onto an intermediate transfer belt 16 described hereinafter. The drum cleaning device 3 removes residual toner after transfer adhered onto the surface of the photoconductor 2 after an intermediate transfer step. The toner recovery device 6 conveys the residual toner after transfer to a toner recovery section 7 which is formed in an upper section of the development device 5. Furthermore, the electric charge removing device removes the residual electric charge of the cleaned photoconductor 2. By this electric charge removal, the surface of the photoconductor 2 is initialized to prepare for the next image formation.

The development device 5 has a vertically long hopper section 5*a* for storing the unshown toner and, a development section 5*b*. In the hopper section 5*a*, there are disposed an agitator 5*c* which is rotary driven by the unshown driving means, a stirring paddle 5*d* which is rotary driven on the lower side of a vertical direction of the agitator 5*c* by the unshown driving means, and a toner supply roller 5*e* which is rotary driven in a vertical direction of the stirring paddle 5*d* by the unshown driving means. The toner inside the hopper section 5*a* is moved toward the toner supply roller 5*e* by the weight of the toner, while being stirred by the rotary drive of the agitator 5*c* and stirring paddle 5*d*. The toner supply roller 5*e* has a metallic cored bar and a roller section coated on a surface of the cored bar and made of resin foam, and is rotated while adhering the toner inside the hopper section 5*a* onto a surface of the roller section. The toner recovery section 7 is provided in an upper section of the hopper section 5*a*, and the residual toner after transfer is stored in the toner recovery section 7.

In the development section 5*b* of the development device 5, there are disposed a developing roller 5*f* which rotates while abutting on the photoconductor 2 or toner supply roller 5*e*, and a thin-layered blade 5*g* which brings a distal end thereof into contact with a surface of the developing roller 5*f*. The toner adhered to the toner supply roller 5*e* inside the hopper section 5*a* is supplied to the surface of the developing roller 5*f* at the section of abutment between the developing roller 5*f* and the toner supply roller 5*e*. When the supplied toner passes through the position of abutment between the developing roller 5*e* and the thin-layered blade 5*g* as the developing roller 5*f* rotates, the thickness of the roller on the surface of the developing roller 5*f* is regulated. Then, in a development region, which is a section of abutment between the developing roller 5*e* and the photoconductor 2, the toner obtained after regulating the thickness thereof is caused to adhere to an electrostatic latent image on the surface of the photoconductor 2. By this adhesion, the electrostatic latent image is developed into a toner image.

In FIG. 2 described above, a light writing unit 70 is disposed on the upper side of vertical directions of the process units 1Y, M, C, K. The light writing unit 70, which is a latent image writing device, optically scans photoconductors 2Y, M, C, K of the process units 1Y, M, C, K by means of the laser beam L emitted from a laser diode on the basis of image information. By this optical scanning, electrostatic latent images for Y, M, C, K are formed on the photoconductors 2Y, M, C, K. It should be noted that the light writing unit 70 radiates the laser beam (L), which is emitted from a light source, via a plurality of optical lenses or mirrors, while polarizing the laser beam L in a main scanning direction by means of a polygon mirror which is rotary driven by an unshown polygon motor.

On the lower side of the vertical directions of the process units 1Y, M, C, K, there is disposed a transfer unit 15, which endlessly moves the endless intermediate transfer belt 16 in a counterclockwise direction in the figure while tightly stretching the intermediate transfer belt 16. The transfer unit 15, which is transferring means, comprises, besides the intermediate transfer belt 16, a driving roller 17, a driven roller 18, four primary transfer rollers 19Y, M, C, K, a secondary transfer roller 20, a belt cleaning device 21, a cleaning backup roller 22, and the like.

The intermediate transfer belt 16 is tightly stretched by the driving roller 17 disposed inside the loop of the intermediate transfer belt 16, the driven roller 18, the cleaning backup roller 22, and the four primary transfer rollers 19Y, M, C, K. The intermediate transfer belt 16 is then moved endlessly in the counterclockwise direction by torque of the driving roller 17 which is rotary driven in the counterclockwise direction in the figure by the unshown driving means.

The intermediate transfer belt 16, which is endlessly moved in the manner described above, is interposed between the four primary transfer rollers 19Y, M, C, K and the photoconductors 2Y, M, C, K. By interposing the intermediate transfer belt 16 in this manner, primary transfer nips for Y, M, C, K at which the intermediate transfer belt 16 contacts with the photoconductors 2Y, M, C, K are formed.

Primary transfer bias is applied to each of the primary transfer rollers 19Y, M, C, K by a transfer bias supply source which is not shown, whereby a transfer electric field is formed between the electrostatic latent images on the photoconductors 2Y, M, C, K and the primary transfer rollers 19Y, M, C, K. It should be noted that a transfer charger or a transfer brush may be employed in place of the primary transfer rollers 19Y, M, C, K.

The Y toner, which is formed on the surface of the photoconductor 2Y of the Y process unit 1Y, enters the abovementioned Y primary transfer nip as the photoconductor 2Y rotates, and is primarily transferred from the photoconductor 2Y onto the intermediate transfer belt 16 by an action of the transfer electric field or nip. When the intermediate transfer belt 16, onto which a Y toner image is primarily transferred, passes through the primary transfer nips for M, C, K while being moved endlessly, M, C, K toner images on the photoconductors 2M, C, K are sequentially superimposed on the Y toner image and primarily transferred. By this superimposed primary transfer, four colors of toner images are formed on the intermediate transfer belt 16.

The intermediate transfer belt 16 is interposed between the secondary transfer roller 20 of the transfer unit 15 and the driven roller 18 inside the loop of the intermediate transfer belt 16, the secondary transfer roller 20 being disposed outside the loop of the intermediate transfer belt 16. By interposing the intermediate transfer belt 16 in this manner, a secondary transfer nip at which the front surface of the intermediate transfer belt 16 contacts with the secondary transfer roller 20 is formed. Secondary transfer bias is applied to the secondary transfer roller 20 by the transfer bias supply source which is not shown. By this application of the bias, a secondary transfer electric field is formed between the secondary transfer roller 20 and the grounded driven roller.

On the lower side of a vertical direction of the transfer unit 15, a paper cassette 30, which stores a plurality of recording papers P in piles, is disposed so as to be slidable and detachable with respect to the chassis of the printer. This paper cassette 30 brings a paper feed roller 30*a* into contact with the top recording papers P of the piled recording papers P, rotates the paper feed roller 30*a* in the counterclockwise direction in the figure at predetermined timing, and thereby sends the top recording paper P toward a paper feed path 31.

A pair of resist rollers 32 are disposed in the vicinity of a tail end of the paper feed path 31. Once the pair of resist rollers 32 interpose the recording paper P therebetween, the recording paper P being sent from the paper cassette 30, the both rollers stop rotating. The rotary drive is restarted at the timing at which the interposed recording paper P can be synchronized with the four colors of toner images formed on the intermediate transfer belt 16, at the abovementioned secondary transfer nip, and the recording paper P is sent toward the secondary transfer nip.

The four colors of toner images, which are formed on the intermediate transfer belt 16 and adhered to the recording paper P at the secondary transfer nip, are secondarily transferred at once onto the recording paper P by the influence of the secondary transfer electric field or nip, and combined with the white color of the recording paper P to form a full-color toner image. When the recording paper P the surface of which is formed with the full-color image passes through the secondary transfer nip, the recording paper P is self-stripped from the secondary transfer roller 20 or the intermediate transfer belt 16. Then, the recording paper P is sent into a fixing device 34 described hereinafter, via a post-transfer conveying path 33.

The residual toner after transfer that was not transferred onto the recording paper P is adhered onto the intermediate transfer belt 16 that has passed through the secondary transfer nip. This residual toner after transfer is wiped off from the surface of the intermediate transfer belt 16 by the belt cleaning device 21 which is in contact with the front surface of the intermediate transfer belt 16. The cleaning backup roller 22, which is disposed inside the loop of the intermediate transfer belt 16, assists cleaning of the belt performed by the belt cleaning device 21, from the inside of the loop.

The fixing device 34 forms a fixing nip by means of a fixing roller 34*a* enclosing an unshown heat generating source such as a halogen lamp, as well as a pressure roller 34*b* which rotates in contact with the fixing device 34 at predetermined pressure. The recording paper P which is sent into the fixing device 34 is interposed in the fixing nip so as to adhere a supporting surface of the unfixed toner image of the recording paper P onto the fixing roller 34*a*. Then, the toner inside the toner image is softened by application of heat or pressure, whereby the full-color image is fixed.

The recording paper P which is discharged from the fixing device 34 passes through a post-fixation conveying path 35, and thereafter reaches a branch point between a paper discharge path 36 and a pre-inversion conveying path 41. A switching nib 42, which is rotary driven around a rotation axis 42*a*, is disposed on a side of the post-fixation conveying path 35, and the vicinity of a tail end of the post-fixation conveying path 35 is closed or opened by rotation of the rotation axis 42*a*. At the timing at which recording paper P is sent from the fixing device 34, the switching nib 42 stops at a rotation position shown by a sold line in the figure, and opens the vicinity of the tail end of the post-fixation conveying path 35. Accordingly, the recording paper P enters the paper discharge path 36 from the post-fixation conveying path 35 and is interposed between a pair of paper discharge rollers 37.

In the case in which a one-side printing mode is set by means of an input operation using an operation section constituted by a numerical keypad or the like which is not shown, or by means of a control signal which is sent from a personal computer or the like which is not shown, the recording paper P interposed between the pair of paper discharge rollers 37 is discharged directly to the outside of the machine. Then, the recording papers P are stacked in a stack section which is an upper surface of a top cover 50 in the chassis.

On the other hand, in the case in which a both-side printing mode is set, when the rear end side of the recording paper P passes through the post-fixation conveying path 35, while the front end of the recording paper P is interposed between the pair of paper discharge rollers 37, the recording paper P being conveyed through the paper discharge path 36, the switching nib 42 turns to a position shown by a dashed line in the figure, whereby the vicinity of the tail end of the post-fixation conveying path 35 is closed. Nearly simultaneously, the pair of paper discharge rollers 37 start to rotate backwards. Consequently, the recording paper P is then conveyed such that the rear end thereof is directed to the front, and enters the pre-inversion conveying path 41.

FIG. 2 shows the front side of the present printer. The near side in a direction perpendicular to the page of the figure is the front surface of the printer, and the far side of same is the rear surface of the printer. Moreover, the right side of the printer in the figure is the right side surface of the printer, and the left side of same is the left side surface of the printer. A right end section of the present printer is a reversing unit 40 which is openable and closable with respect to the chassis main body by rotating around a rotation axis 40*a*. When the pair of paper discharge rollers 37 rotate backwards, the recording paper P enters the pre-inversion conveying path 41 of the reversing unit 40 and is conveyed from the upper side to the lower side in the vertical direction. Then, the recording paper P passes through a pair of reversing conveying rollers 43 and thereafter enters a reversing conveying path 44 which is curved in a semicircle. Moreover, when the recording paper P is conveyed along the curved shape, the upper and lower surfaces of the recording paper P are reversed, and at the same time the traveling direction extending from the upper side toward the lower side in the vertical direction is also reversed, whereby the recording paper P is conveyed from the lower side to the upper side in the vertical direction. Thereafter, the recording paper P passes through the abovementioned paper feed path 31 to enter the secondary transfer nip. After the full-color image is secondarily transferred onto the other side of the recording paper P at once, the recording paper P is discharged to the outside of the machine via, successively, the post-transfer conveying path 33, fixing device 34, post-fixation conveying path 35, paper discharge path 36, and pair of paper discharge rollers 37.

The abovementioned reversing unit 40 has an external cover 45 and an oscillating body 46. Specifically, the external cover 45 of the reversing unit 40 is supported so as to rotate around the rotation axis 40*a* provided in the chassis of the printer main body. By this rotation, the external cover 45 opens and closes with respect to the chassis, along with the oscillating body 46 held inside the external cover 45. As shown by a dotted line in the figure, when the external cover 45 is opened along with the oscillating body 46 therein, the paper feed path 31, secondary transfer nip, post-transfer conveying path 33, fixing nip, post-fixation conveying path 35, and paper discharge path 36 formed between the reversing unit 40 and printer main body side are divided vertically into two sections and exposed to the outside. Accordingly, jammed papers inside the paper feed path 31, secondary transfer nip, post-transfer conveying path 33, fixing nip, post-fixation conveying path 35, and paper discharge path 36 can be eliminated easily.

Moreover, the oscillating body 46 is supported by the external cover 45 so as to rotate around an unshown rocking shaft provided on the external cover 45, in a state in which the external cover 45 is opened. When the oscillating body 46 is opened with respect to the external cover 45 by this rotation, the pre-inversion conveying path 41 and reversing conveying path 44 are vertically divided into two sections and exposed to the outside. Accordingly, jammed papers inside the pre-inversion conveying path 41 and reversing conveying path 44 can be eliminated easily.

The top cover 50 of the chassis of the printer is supported so as to be rotatable around a rotation axis 51 as shown by an arrow in the figure. When the top cover 50 rotates in the counterclockwise direction in the figure, the top cover 50 opens with respect to the chassis. Then, an upper opening of the chassis is exposed largely to the outside. Accordingly, the light writing unit 70 is exposed.

Next, the toner recovery device 6, which is a characteristic of the present printer, is described in detail.

Figure 4:
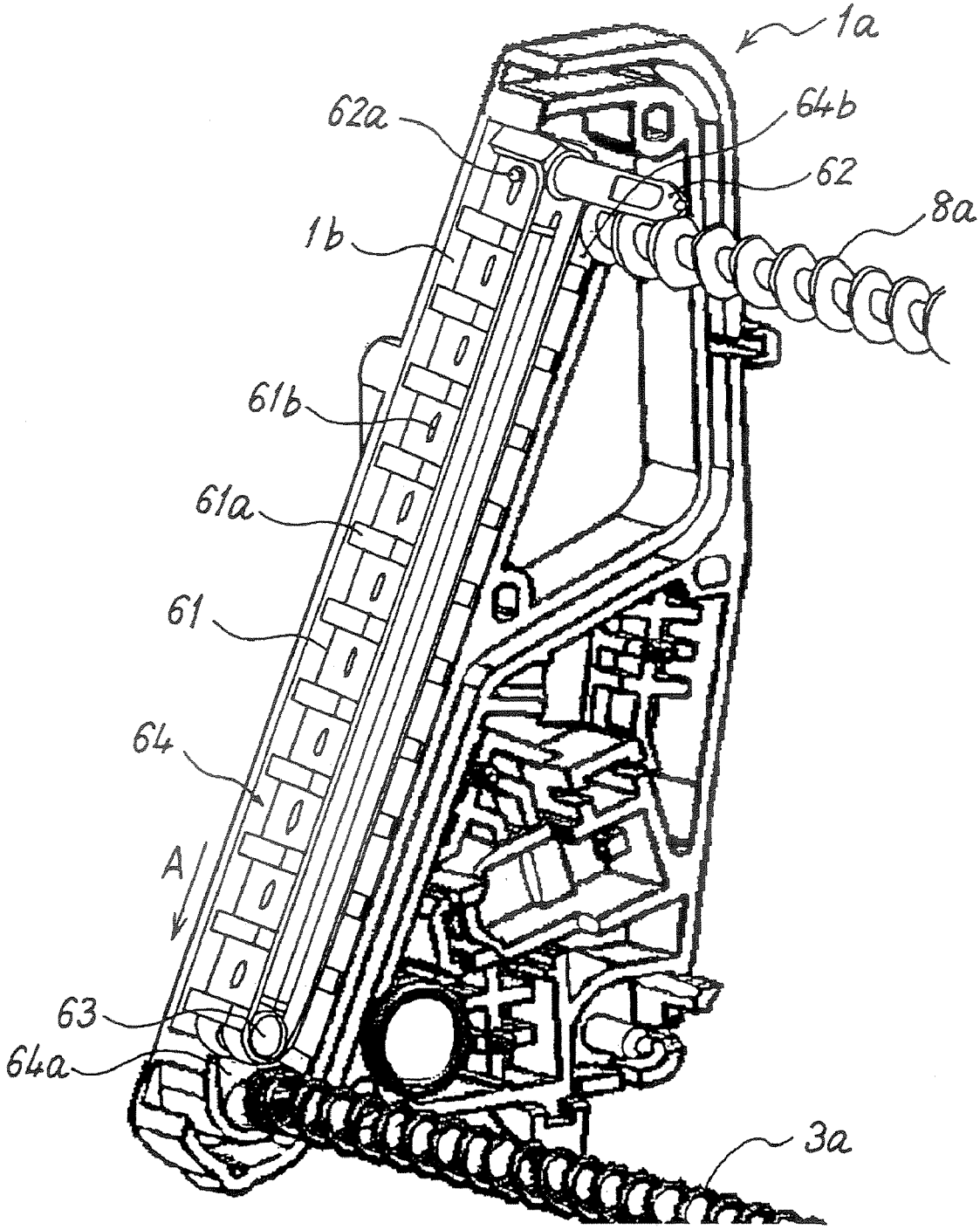
FIG. 4 is a perspective view showing a configuration of a substantial part of a toner recovery device in the printer.

FIG. 4 is a schematic configuration diagram of the toner recovery device 6. An endless groove section 1*b* is formed on a process cartridge side surface 1*a*, and a toner-conveying pipe 64 with a square cross section is formed by covering the groove section 1*b* with an unshown cover member. The toner-conveying pipe 64 extends in a tilted manner from a lower side to an upper side. A lower section on a side surface on the near side of the toner-conveying pipe 64 is provided with an opened carry-in section 64*a*, and a toner-conveying screw 3*a* of the drum cleaning device 3 is connected to the carry-in section 64*a*. Also, there is provided a carry-out section 64*b* which is opened with respect to an upper section of the side surface on the near side of the toner-conveying pipe 64 and to a belt opposite surface on the lower side, and this carry-out section 64*b* is connected to a toner recovery path 8 having a toner recovery screw 8*a* therein. An endless toner-conveying belt 61 is provided inside the toner-conveying pipe 64, and this toner-conveying belt 61 is tightly stretched by a driven roller 63 and driving roller 62. The driven roller 63 and driving roller 62 are supported rotatably by a toner-conveying pipe on a side surface of the process cartridge. The driving roller 62 is connected to the unshown driving means and is rotary driven. Furthermore, a pin 62*a*, which is a protrusion extending from the driving roller 62, is provided on the driving roller.

A protruding section 61*a* is formed on an outer peripheral surface of the toner-conveying belt 61. Furthermore, a long hole 61*b* extending in a belt moving direction is formed between the protruding sections, and this long hole 61*b* is provided so as to follow a rotation pitch of the pin 62*a* of the driving roller 62. The pin 62*a*, which is the protrusion extending from the driving roller 62, passes through the long hole 61*b* and engages with the long hole 61*b* in a section of the belt which is wound around the driving roller 62. When the driving roller 62 of the toner-conveying belt 61 rotates, the pin 62*a* engages with the long hole, the driving force of the rotation of the toner-conveying belt 61 is transmitted via the pin 62*a*, and the toner-conveying belt 61 is rotary driven in an A direction shown in the figure.

Figure 5:
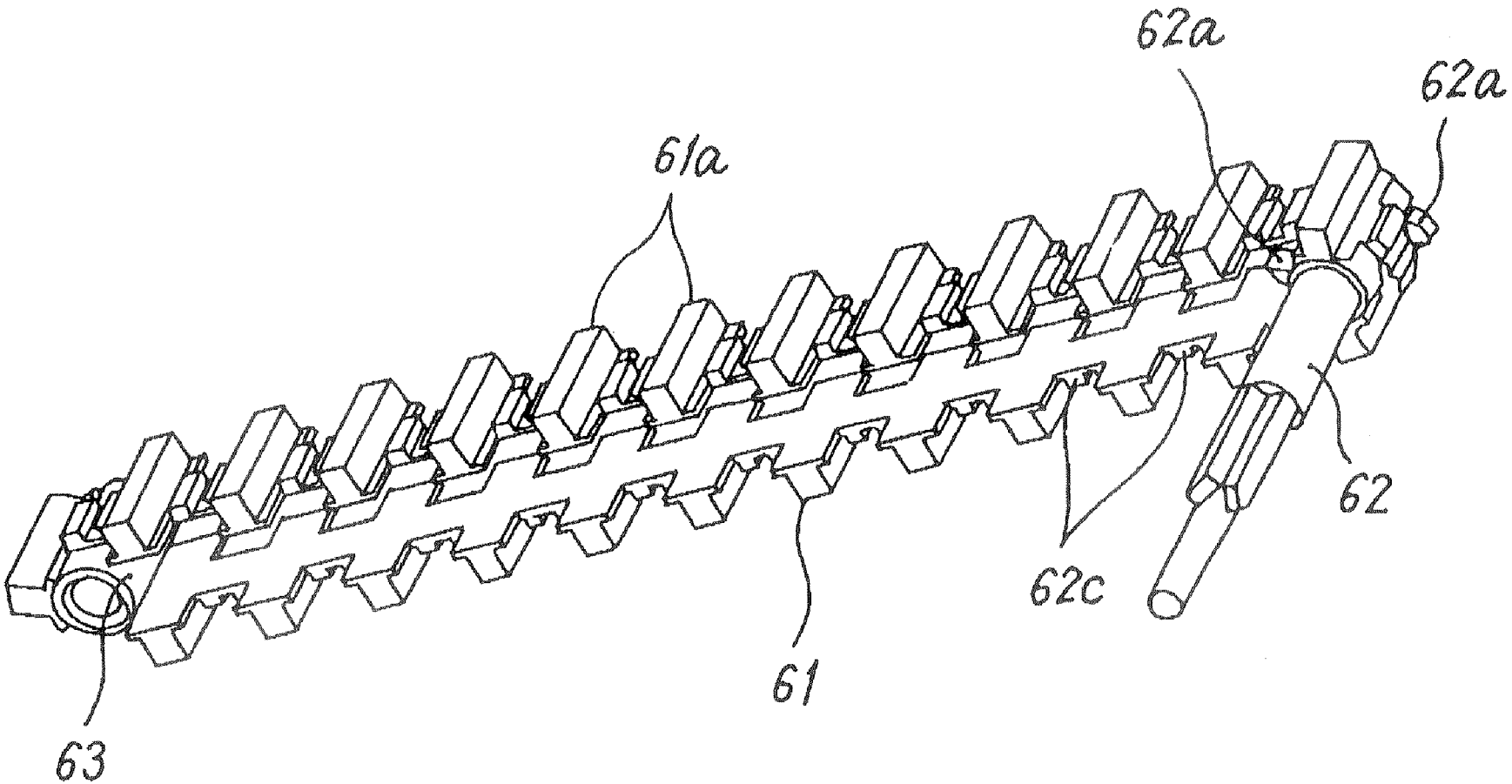
FIG. 5 is a figure showing a configuration of a toner-conveying belt of the toner recovery device.

Moreover, in the case in which the toner-conveying belt 61 is a rubber, even if the dimensional relationship of the long hole 61*b* to the pin 62*a* is rough, the long hole 61*b* can be deformed and the pin 62*a* can pass through the long hole 61*b* to engage therewith. However, in the case in which the toner-conveying belt 61 is thermoplastic elastomer, if the dimensional relationship between the pin 62*a* and the long hole 61*b* is rough, there arises a problem that the pin 62*a* cannot pass through the long hole 61*b*. Therefore, when the toner-conveying belt 61 is thermoplastic elastomer or other material which is difficult to be deformed compared to rubber, a notch section 62*c* is provided on both ends in a belt width direction between the protruding sections, as shown in FIG. 5. Then, the pin 62*a* of the driving roller 62 and the notch sections 62*c* on both ends are placed alternately. Accordingly, the belt 61 and the driving roller 62 engage with each other, and the driving force of the rotation of the driving roller 62 is transmitted to the toner-conveying belt 61, whereby the toner-conveying belt 61 is rotary driven.

A space between the protruding sections 61*a* of the toner-conveying belt 61 has the same width as the belt width, and the height of the protruding section is set such that the top surface thereof contacts tightly with the belt opposite surface of the toner-conveying belt 64. Moreover, the protruding section 61*a* has a certain amount of thickness so that the protruding section 61*a* is not deformed by frictional force between the protruding section 61*a* and the toner-conveying pipe 64 or by the weight of the residual toner after transfer. In the present embodiment, the toner-conveying belt 61 is rotated in the A direction shown in the figure, and the residual toner after transfer is held by a bottom surface of the toner-conveying pipe 64 and protruding section 61*a* and conveyed to the carry-out section 64*b*. Therefore, if the protruding section 61*a* is deformed by the frictional force between the protruding section 61*a* and the toner-conveying pipe 64 or by the weight of the residual toner after transfer, the residual toner after transfer is collected at the top section of the protruding section 61*a*, whereby the weight of the residual toner after transfer is concentrated on the top section of the protruding section 61*a*. As a result, the protruding section continues to deform, a space is generated between the top section of the protruding section 61*a* and the bottom surface of the toner-conveying pipe 64, and the residual toner after transfer falls, whereby the amount of residual toner after transfer to be conveyed may be reduced. Therefore, in the present embodiment, the thickness of the protruding section 61*a* is set so that the protruding section 61*a* is not deformed by the weight of the residual toner after transfer or the frictional force between the protruding section 61*a* and the toner-conveying pipe 64, and such a space is prevented from being formed between the top section of the protruding section 61*a* and an inner wall of the toner-conveying pipe 64.

Figure 6:
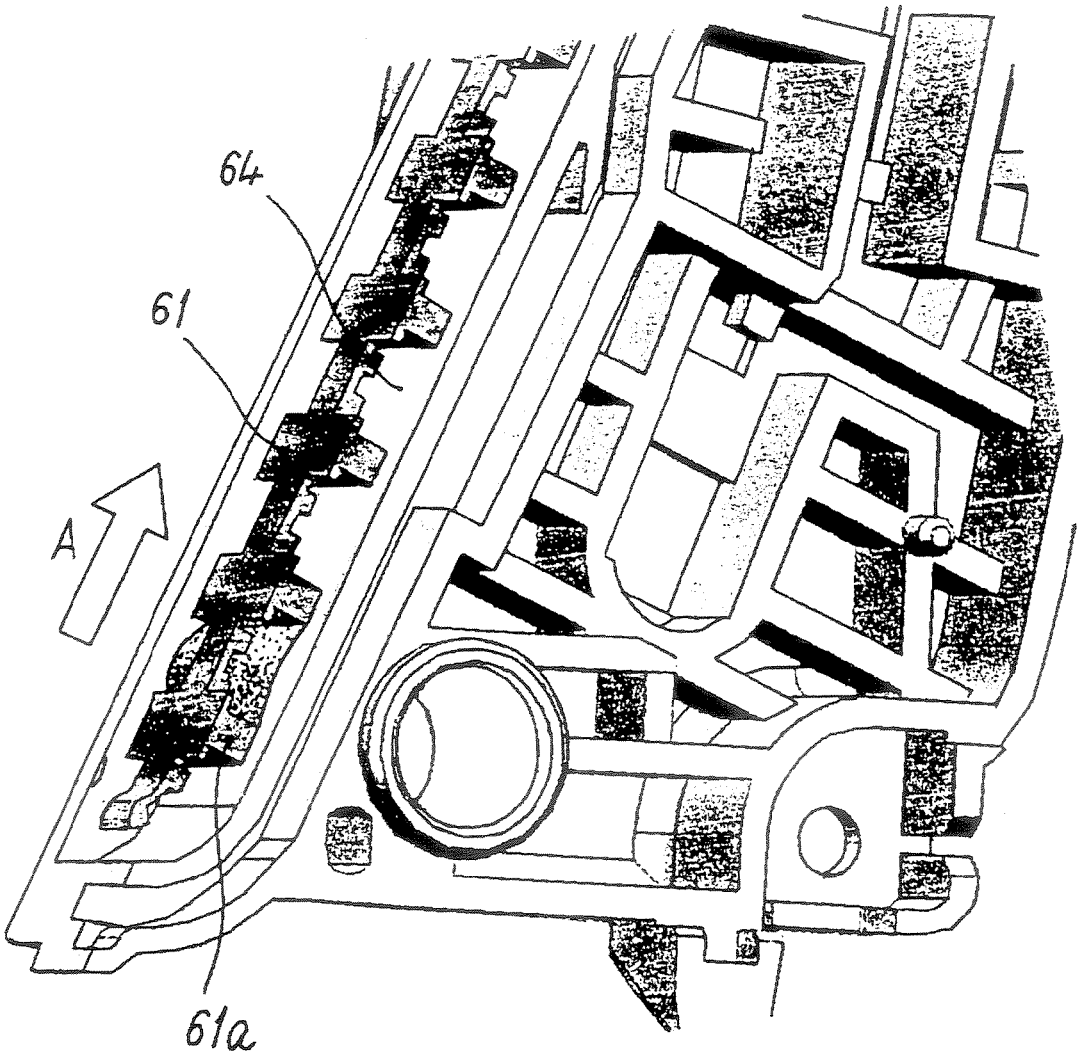
FIG. 6 is a figure for explaining a state of conveying residual toner after transfer in the present embodiment.

The residual toner after transfer, which is removed by the drum cleaning device 3, is conveyed to the carry-in section 64*a* on the lower side of the toner-conveying pipe 64 by the toner-conveying screw 3*a*. The residual toner after transfer conveyed to the lower side of the toner-conveying pipe 64 is scraped off by the protruding section 61*a* of the toner-conveying belt 61. The residual toner after transfer scraped off by the protruding section 61*a* is held by the protruding sections 61*a* and the bottom surface of the toner-conveying pipe 64 as shown in FIG. 6, and conveyed upward. When the toner-conveying belt 61 conveys the residual toner after transfer to the carry-out section 64*b* provided on the upper side of the toner-conveying pipe 64, the residual toner after transfer falls from the carry-out section 64*b* to the toner recovery path 8. The residual toner after transfer that has fallen onto the toner recovery path 8 is conveyed to the toner recovery section 7 by the toner recovery screw 8*a* and collected.

The toner-conveying belt 61 of the present embodiment rotates in the A direction shown in the figure, and conveys the residual toner after transfer through the lower conveying path (a region in which the outer peripheral surface of the toner-conveying belt faces the bottom surface of the toner-conveying pipe) out of the two conveying paths conveying the lower residual toner after transfer upward.

Figure 7:
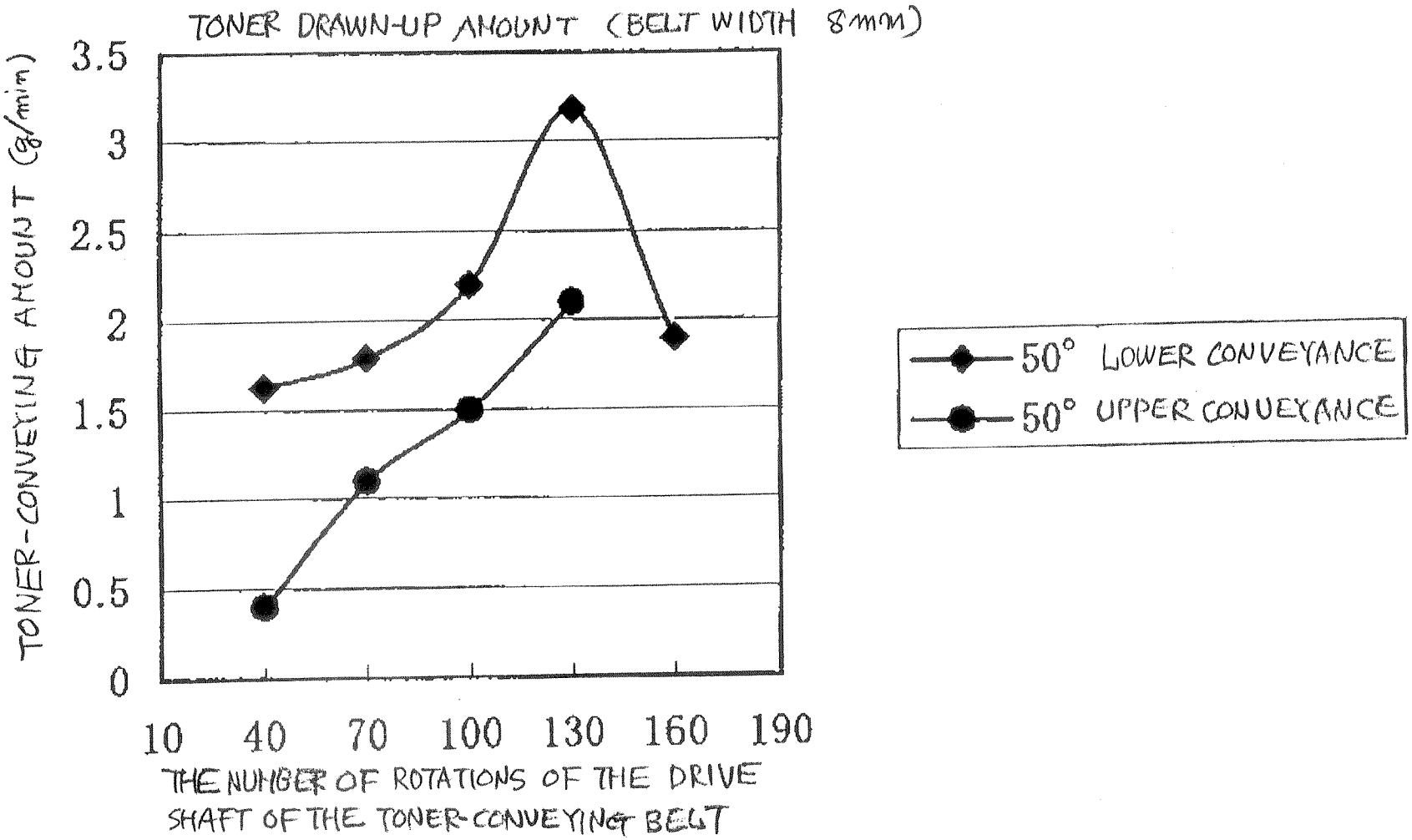
FIG. 7 is a graph showing the relationship of toner-conveying amount to the number of rotations of a drive shaft of the toner-conveying belt.

FIG. 7 is a graph for examining the conveying amount which is obtained when the toner-conveying belt is rotated in the A direction shown in the figure and the residual toner after transfer is conveyed through the lower conveying path (lower conveyance), and when the toner-conveying belt is rotated in the direction opposite to the A direction shown in the figure and the residual toner after transfer is conveyed through the upper conveying path (upper conveyance). A toner recovery device was used in which the width of the toner-conveying belt is 8 [mm], the height of the protruding section is 2 [mm], the number of protruding sections Z=24, the pitch of the protruding sections is 15.7 [mm], the length of the inner periphery is 376 [mm], and the diameter of the driving roller is 5 [mm]. Moreover, the angle of inclination of the toner-conveying pipe is 50°. In the examination, the toner weight, which was obtained one minute after the toner is discharged to the carry-out section 64*b*, was measured.

As shown in FIG. 6, it can be seen that the amount of toner to be conveyed is larger when the residual toner after transfer is conveyed through the lower conveying path than when the residual toner after transfer is conveyed through the upper conveying path. When the residual toner after transfer is conveyed through the upper conveying path, the residual toner after transfer is supported by the toner-conveying belt 61 and conveyed such that the residual toner after transfer is held by the outer peripheral surface of the toner-conveying belt and the protruding sections 61*a*. Therefore, oscillation of the belt, which is caused when, for example, the pin 62*a* passes through the long hole 61*b* of the toner-conveying belt 61, is transmitted to the supported residual toner after transfer. As a result, the residual toner after transfer oscillates and spills out of a space between the inner wall of the toner-conveying pipe and the protruding sections 61*a*. On the other hand, when the transferred toner is conveyed through the lower conveying path, the residual toner after transfer is conveyed while being held by the inner wall of the toner-conveying pipe and the protruding sections. Therefore, oscillation of the belt is transmitted only from the protruding sections to the residual toner after transfer. Therefore, the oscillation of the belt is not transmitted easily to the residual toner after transfer, compared to the case of using the upper conveying path. As a result, oscillation of the transferred residual belt is prevented, and the amount of residual toner after transfer spilling out of the space between the protruding sections 61*a* and the inner wall of the toner-conveying pipe 64 is also reduced more, compared to the case where the residual toner after transfer is conveyed by means of upper conveyance. Therefore, it is considered that the amount of toner to be conveyed is larger in lower conveyance than in the upper conveyance. Furthermore, when the residual toner after transfer is conveyed by means of upper conveyance, the residual toner after transfer spills out of the long hole. However, when the residual toner after transfer is conveyed by means of lower conveyance, the residual toner after transfer does not spill out of the long hole, thus it is considered that the amount of toner to be conveyed is larger in lower conveyance than in upper conveyance. According to this result, it is preferred that the residual toner after transfer be conveyed by means of lower conveyance. Moreover, it can be seen that the number of rotations of the transfer conveying belt is preferably 130 rpm.

As described above, the toner recovery device of the present embodiment has the following characteristics.

(1) The residual toner after transfer, which is carried into the carry-in section of the toner-conveying pipe, is held by the protruding sections of the toner-conveying belt and the bottom surface of the toner-conveying pipe and conveyed to the carry-out section, whereby the residual toner after transfer can be prevented from oscillating while being conveyed to the carry-out section. Therefore, the residual toner after transfer can be prevented from spilling out of the space between the protruding sections and the inner wall of the toner-conveying pipe, and the amount of residual toner after transfer to be conveyed to the carry-out section can be prevented from being reduced.

(2) The toner-conveying belt is tightly stretched by the driving roller and the driven roller by using minimum necessary members. Accordingly, the device can be configured at low cost. The length of the transfer conveying belt in a vertical direction when viewing the transfer conveying belt from the axial cross section can be made short to reduce the size of the device.

(3) The pin is provided as a protrusion on the driving roller, and the pin is caused to engage with the toner-conveying belt, whereby the toner-conveying belt is rotary driven. Accordingly, the driving force of the rotation of the driving roller can be transmitted smoothly to the toner-conveying belt.

(4) The hole section or notch section is provided on the toner-conveying belt, and the protrusion of the driving roller is in engagement with the hole section or notch section, whereby the toner-conveying belt is rotary driven. When a groove or the like engaging with the pin is provided on the inner peripheral surface of the toner-conveying belt, the thickness of the belt is increased, and when the diameter of the driving roller or driven roller is reduced, the belt cannot be wound around the roller. However, by providing the hole section or notch section on the toner-conveying belt and causing the pin of the driven roller to engage with the hole section or notch section, the thickness of the toner-conveying belt can be reduced, and even if the diameter of the driving roller or driven roller is reduced, the belt can be wound around the roller. As a result, the size of the device can be reduced.

(5) Furthermore, the process cartridge of the present embodiment comprises the toner recovery device having any of the above characteristics (1) through (4), thus the residual toner after transfer can be conveyed to the toner recovery section in a good manner.

(6) Also, by providing the conveying pipe of the toner recovery device on a side surface of the process cartridge, the toner-conveying pipe can be prevented from interfering with the image formation processing means such as the development roller or photoconductors.

(7) Moreover, the process cartridge of the present embodiment comprises the toner recovery device having any of the above characteristics (1) through (4), thus the residual toner after transfer can be conveyed to the toner recovery section in a good manner.

As described above, according to the present invention, the residual toner after transfer, which is carried into the carry-in section of the toner-conveying pipe, is conveyed to the carry-out section as follows. Specifically, the residual toner after transfer is conveyed while being held by the protruding sections of the toner-conveying belt and the bottom surface of the toner-conveying pipe. The residual toner after transfer is conveyed to the carry-out section in this manner, thus the following effects can be achieved. Specifically, the residual toner after transfer is conveyed to the carry-out section without being supported on the toner-conveying belt. Therefore, the influence of the oscillation of the toner-conveying belt can be alleviated more, compared to the case where the residual toner after transfer is supported on the toner-conveying belt. Consequently, the residual toner after transfer can be prevented from spilling out of the space between the protruding sections and the inner wall of the toner-conveying pipe, while such phenomenon cannot be prevented when the residual toner after transfer is held by the outer peripheral surface between the protruding sections of the toner-conveying belt and the protruding sections. Therefore, the amount of residual toner after transfer to be conveyed to the carry-out section can be increased more, compared to the case where the residual toner after transfer is conveyed while being held by the outer peripheral surface between the protruding sections of the toner-conveying belt and the protruding sections.

Various modifications will become possible for those skilled in the art after receiving the teachings of the present disclosure without departing from the scope thereof.

What is claimed is:

1. A toner recovery device which conveys residual toner to a toner recovery section, comprising:

a toner-conveying pipe extending obliquely upward and having a carry-in section which is provided in a lower section of the toner-conveying pipe and into which the residual toner is carried, and a carry-out section which is provided in an upper section of the toner-conveying pipe and conveys the residual toner after transfer to the toner recovery section;

an endless toner-conveying belt which has a plurality of protruding sections on an outer peripheral surface thereof, the endless conveying belt having a center along a lengthwise direction, and the endless conveying belt including notches formed on each side of the center; and two rollers around which the endless toner conveying belt is disposed, at least one of the rollers including at least two pins which are on different circumferential positions of the at least one of the two rollers such that the at least two pins engage with the notches of the endless conveying belt;

wherein the toner-conveying belt is rotated by the pins such that the toner-conveying belt descends in a region in which the outer peripheral surface of the toner-conveying belt faces a ceiling surface of the toner-conveying pipe, and that the toner-conveying belt rises in a region in which the outer peripheral surface of the toner-conveying belt faces a bottom surface of the toner-conveying pipe, and the residual toner after transfer carried into the carry-in section is held by the protruding sections of the conveying belt and the bottom surface of the toner-conveying pipe, and conveyed to the carry-out section.

2. A toner recovery device according to claim 1, wherein the endless toner-conveying belt comprises a material which is less deformable than rubber.

3. A toner recovery device according to claim 1, wherein the endless toner-conveying belt comprises a thermoplastic elastomer.

4. A toner recovery device according to claim 1, wherein said at least one of the two rollers including the at least two pins has the at least two pins arranged such that the pins alternately engage with the notches on different sides of the endless toner-conveying belt.

5. A process cartridge which is detachable with respect to an image forming apparatus main body, the process cartridge comprising:

an image supporting body;

a cleaner configured to remove residual toner after transfer adhered to the image supporting body; and a toner recovery device which conveys the residual toner after transfer removed by the cleaner to a toner recovery section, the toner recovery device comprising:

a toner-conveying pipe extending obliquely upward and having a carry-in section which is provided in a lower section of the toner-conveying pipe and into which the residual toner after transfer removed by the cleaner is carried, and a carry-out section which is provided in an upper section of the toner-conveying pipe and conveys the residual toner after transfer to the toner recovery section;

an endless toner-conveying belt which has a plurality of protruding sections on an outer peripheral surface thereof, the endless conveying belt having a center along a lengthwise direction, and the endless conveying belt including notches formed on each side of the center; and two rollers around which the endless toner conveying belt is disposed, at least one of the rollers including at least two pins which are on different circumferential positions of the at least one of the two rollers such that the at least two pins engage with the notches of the endless conveying belt;

wherein the toner-conveying belt is rotated by the pins such that the toner-conveying belt descends in a region in which the outer peripheral surface of the toner-conveying belt faces a ceiling surface of the toner-conveying pipe, and that the toner-conveying belt rises in a region in which the outer peripheral surface of the toner-conveying belt faces a bottom surface of the toner-conveying pipe, and the residual toner after transfer carried into the carry-in section is held by the protruding sections of the conveying belt and the bottom surface of the toner-conveying pipe, and conveyed to the carry-out section.

6. The process cartridge as claimed in claim 5, wherein the conveying pipe is provided on a side surface of the process cartridge.

7. A process cartridge according to claim 5, wherein the endless toner-conveying belt comprises a material which is less deformable than rubber.

8. A process cartridge according to claim 5, wherein the endless toner-conveying belt comprises a thermoplastic elastomer.

9. A process cartridge according to claim 5, wherein said at least one of the two rollers including the at least two pins has the at least two pins arranged such that the pins alternately engage with the notches on different sides of the endless toner-conveying belt.

10. An image forming apparatus comprising:

an image forming section;

a cleaning device; and a toner recovery device which conveys residual toner after transfer removed by the cleaning device to a toner recovery section, the toner recovery device comprising:

a toner-conveying pipe extending obliquely upward and having a carry-in section which is provided in a lower section of the toner-conveying pipe and into which the residual toner after transfer removed by the cleaning device is carried, and a carry-out section which is provided in an upper section of the toner-conveying pipe and conveys the residual toner after transfer to the toner recovery section;

an endless toner-conveying belt which has a plurality of protruding sections on an outer peripheral surface thereof, the endless conveying belt having a center along a lengthwise direction, and the endless conveying belt including notches formed on each side of the center; and two rollers around which the endless toner conveying belt is disposed, at least one of the rollers including at least two pins which are on different circumferential positions of the at least one of the two rollers such that the at least two pins engage with the notches of the endless conveying belt;

wherein the toner-conveying belt is rotated by the pins such that the toner-conveying belt descends in a region in which the outer peripheral surface of the toner-conveying belt faces a ceiling surface of the toner-conveying pipe, and that the toner-conveying belt rises in a region in which the outer peripheral surface of the toner-conveying belt faces a bottom surface of the toner-conveying pipe, and the residual toner after transfer carried into the carry-in section is held by the protruding sections of the conveying belt and the bottom surface of the toner-conveying pipe, and conveyed to the carry-out section.

11. An image forming apparatus according to claim 10, wherein the endless toner-conveying belt comprises a material which is less deformable than rubber.

12. An image forming apparatus according to claim 10, wherein the endless toner-conveying belt comprises a thermoplastic elastomer.

13. An image forming apparatus according to claim 10, wherein said at least one of the two rollers including the at least two pins has the at least two pins arranged such that the pins alternately engage with the notches on different sides of the endless toner-conveying belt.

* * * * *